US009805735B2

(12) United States Patent
Nagel et al.

(10) Patent No.: US 9,805,735 B2
(45) Date of Patent: Oct. 31, 2017

(54) APPARATUS, METHOD AND COMPUTER PROGRAM FOR GENERATING A WIDEBAND SIGNAL USING GUIDED BANDWIDTH EXTENSION AND BLIND BANDWIDTH EXTENSION

(71) Applicant: Fraunhofer-Gesellschaft zur Foerderung der angewandten Forschung e.V., Munich (DE)

(72) Inventors: Frederik Nagel, Nuremberg (DE); Max Neuendorf, Nuremberg (DE); Markus Schnell, Nuremberg (DE); Markus Multrus, Nuremberg (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 953 days.

(21) Appl. No.: 13/650,673

(22) Filed: Oct. 12, 2012

(65) Prior Publication Data

US 2013/0041673 A1 Feb. 14, 2013

Related U.S. Application Data

(63) Continuation of application No. PCT/EP2011/055889, filed on Apr. 14, 2011.
(Continued)

(51) Int. Cl.
*G10L 19/00* (2013.01)
*G10L 21/038* (2013.01)

(52) U.S. Cl.
CPC ..... *G10L 21/038* (2013.01)

(58) Field of Classification Search
CPC ..... G10L 21/038; G10L 19/00; G10L 19/005; G10L 19/012; G10L 19/0212;
(Continued)

(56) References Cited

U.S. PATENT DOCUMENTS 5,455,888 A * 10/1995 Iyengar et al. ..... 704/203
5,950,153 A * 9/1999 Ohmori et al. ..... 704/217
(Continued)

FOREIGN PATENT DOCUMENTS

JP 2001-521648 11/2001
JP 2008-535027 8/2008
(Continued)

OTHER PUBLICATIONS

Arora, et al., "High Quality Blind Bandwidth Extension of Audio for Portable Player Applications," Proceedings of the AES 120th Convention, May 20-23, 2006.*
(Continued)

*Primary Examiner* — Abdelali Serrou
(74) *Attorney, Agent, or Firm* — Perkins Coie LLP; Michael A. Glenn

(57) ABSTRACT

An apparatus, method and computer program for generating a wideband signal using a lowband input signal includes a processor for performing a guided bandwidth extension operation using transmitted parameters and a blind bandwidth extension operation only using derived parameters rather than transmitted parameters. To this end, the processor includes a parameter generator for generating the parameters for the blind bandwidth extension operation.

13 Claims, 6 Drawing Sheets

Related U.S. Application Data

(60) Provisional application No. 61/324,962, filed on Apr. 16, 2010.

(58) Field of Classification Search
CPC ..... G10L 19/025; G10L 19/03; G10L 19/04; G10L 19/107; G10L 19/12; G10L 19/22; G10L 19/24; G10L 21/0216; G10L 25/06; G10K 11/16
See application file for complete search history.

(56) References Cited

U.S. PATENT DOCUMENTS

| | | | | |
|---|---|---|---|---|
| 6,680,972 | B1 | 1/2004 | Liljeryd et al. | |
| 6,895,375 | B2 * | 5/2005 | Malah et al. | 704/219 |
| 7,469,206 | B2 * | 12/2008 | Kjorling et al. | 704/205 |
| 8,032,369 | B2 * | 10/2011 | Manjunath | 704/229 |
| 8,296,159 | B2 * | 10/2012 | Neuendorf | G10L 19/0208 704/200 |
| 8,433,582 | B2 * | 4/2013 | Ramabadran | G10L 21/038 367/136 |
| 8,831,958 | B2 * | 9/2014 | Lee | G10L 19/025 704/216 |
| 8,886,346 | B2 * | 11/2014 | Villemoes | G10L 21/038 381/98 |
| 2002/0082335 | A1 | 6/2002 | Eichenauer | |
| 2002/0103637 | A1 * | 8/2002 | Henn et al. | 704/206 |
| 2002/0128838 | A1 | 9/2002 | Veprek | |
| 2003/0187663 | A1 * | 10/2003 | Truman | G10L 21/038 704/500 |
| 2004/0078205 | A1 * | 4/2004 | Liljeryd et al. | 704/503 |
| 2004/0125878 | A1 * | 7/2004 | Liljeryd et al. | 375/242 |
| 2004/0131203 | A1 * | 7/2004 | Liljeryd et al. | 381/98 |
| 2004/0176961 | A1 * | 9/2004 | Manu | G10L 21/038 704/500 |
| 2005/0096917 | A1 * | 5/2005 | Kjorling | G10L 19/24 704/500 |
| 2007/0282603 | A1 * | 12/2007 | Bessette | 704/219 |
| 2008/0004866 | A1 * | 1/2008 | Virolainen et al. | 704/205 |
| 2009/0041111 | A1 * | 2/2009 | Liljeryd et al. | 375/240 |
| 2009/0132261 | A1 * | 5/2009 | Kjorling et al. | 704/500 |
| 2009/0203395 | A1 * | 8/2009 | Korner | 455/550.1 |
| 2009/0234646 | A1 * | 9/2009 | Kjorling | G10L 19/0204 704/225 |
| 2010/0085102 | A1 * | 4/2010 | Lee | G10L 19/008 327/334 |
| 2010/0114583 | A1 * | 5/2010 | Lee | G10L 19/025 704/500 |

FOREIGN PATENT DOCUMENTS

| | | |
|---|---|---|
| JP | 5227489 | 3/2013 |
| RU | 2294565 | 2/2007 |
| WO | WO-98/57436 | 12/1998 |
| WO | WO-2005/043511 | 5/2005 |
| WO | WO-2006/107840 | 10/2006 |
| WO | WO 2010/003557 | 1/2010 |

OTHER PUBLICATIONS

Bernd Geiser et al.: "Artificial Bandwidth Extension without Side Information for ITU-T G.729.1", Aug. 27, 2007.
Bernd Geiser et al.: "Beyond Wideband Telephony—Bandwidth Extension for Super-Wideband Speech", Mar. 3, 2008.
G.729 based Embedded Variable bit-rate coder: An 8-32 kbit/s scalable wideband coder bitstream interoperable with G.729; G.729.1 (May 2006), May 29, 2006.

* cited by examiner

APPARATUS, METHOD AND COMPUTER PROGRAM FOR GENERATING A WIDEBAND SIGNAL USING GUIDED BANDWIDTH EXTENSION AND BLIND BANDWIDTH EXTENSION

CROSS-REFERENCE TO RELATED APPLICATIONS

This application is a continuation of copending International Application No. PCT/EP2011/055889, filed Apr. 14, 2011, which is incorporated herein by reference in its entirety, and additionally claims priority from U.S. Patent Application No. 61/324,962, filed Apr. 16, 2010, which is also incorporated herein by reference in its entirety.

BACKGROUND OF THE INVENTION

The present invention relates to audio processing, and specifically to a device and method and computer program for combined blind and guided bandwidth extension.

Storage or transmission of audio signals is often subject to strict bitrate constraints. In the past, coders were forced to drastically reduce the transmitted audio bandwidth when only a very low bitrate was available. Modern audio codecs are nowadays able to code wideband signals by using bandwidth extension (BWE) methods. These algorithms rely on a parametric representation of the high-frequency content (HF)—which is generated from the waveform coded low-frequency part (LF) of the decoded signal by means of transposition into the I-IF spectral region ("patching") and application of a parameter driven post processing.

The post processing includes the adaptation of energy levels to target the energy distribution of the original signal (also known as. envelope shaping) but also the adaptation of the perceived tonality in the transposed HF bands with the help of band selective inverse filtering (decreasing tonality), addition of a synthetic noise floor (decreasing tonality) or addition of individual sinusoids (increasing tonality).

The BWE exploits the correlation between LF and HF and aims at generating HF information which is as similar to original HF content as possible. Such a BWE extends the frequency up to a certain highest frequency Fmax. The decision of highest frequency thereby depends on a trade-off of quality and bitrate.

U.S. Pat. No. 6,680,972 B1 discloses a source coding enhancement technique using spectral band replication. Bandwidth reduction prior to or in the encoder is followed by spectral band replication at the decoder. This is accomplished by the use of transposition methods in combination with spectral envelope adjustments. A reduced bitrate at a given perceptual quality or an improved perceptual quality at a given bitrate is obtained.

A related technology is included in the MPEG-4 standard (ISO/IEC 14496-3: 2005(E)). Particularly, section 4.6.18 of this standard comprises the spectral band replication (SBR) tool. This tool extends the audio bandwidth of the decoded bandwidth-limited audio signal. This process is based on replication of the sequences of harmonics, previously truncated in order to reduce data rate from the available bandwidth limited signal and control data obtained from the encoder. The ratio between tonal and noise-like components is maintained by adaptive inverse filtering as well as an addition of noise and sinusoidals. The control data obtained from the encoder comprise spectral envelope adjustment data for adjusting the spectral envelope of the patched signal and, additionally, inverse filtering data for setting the ratio between tonal and noise-like components, information on noise to be added to the patched signal and information on missing harmonics to be added to the patched signal within an SBR operation for generating a wideband signal.

This standardized procedure only performs a guided bandwidth extension, since the maximum frequency up to which a wideband signal is generated is also reflected by the parametric data attached to the lowband high resolution signal. Hence, for improving the quality of the audio signal by generating a higher bandwidth signal, additional parametric data is necessitated which additionally enhances the bitrate of the transmitted data. On the other hand, when the bitrate is to be reduced for transmission channel capacity reasons, then one might cut parametric data for the highest or some of the highest bands of the replicated signal at the encoder. This automatically results in a reduction of the audio quality, since an SBR decoder will only generate a high frequency portion up to a frequency, i.e. up to a certain band, for which parametric data is included in the incoming data or bitstream. Hence, reducing the bitrate results in a reduction of the audio quality or an enhancement of the audio quality results in an increase of the bitrate.

SUMMARY

According to an embodiment, an apparatus for generating a wideband signal using a lowband input signal and a first parameter set describing the frequency content above a maximum frequency of the lowband input signal and up to a first frequency, wherein parameters describing a frequency content above the first frequency are not included in the first parameter set, may have: a processor for performing a guided bandwidth extension operation using the lowband input signal and the first parameter set to generate a first frequency content extending up to the first frequency, and for performing a blind bandwidth extension operation using the first frequency content and a second parameter set to generate a second frequency content extending up to a second frequency being higher than the first frequency, wherein the processor is configured to extract the first parameter set and the lowband input signal from a bitstream; perform the guided bandwidth extension using a patch of the lowband input signal and the first parameter set comprising shaping using the first parameter set to obtain a first shaped signal, wherein the patching generates the first frequency content; and performing the blind bandwidth extension using a patching of the first shaped signal and the second parameter set, wherein the patching of the first shaped signal generates the second frequency content, wherein the processor comprises a parameter generator for generating the second parameter set from the first frequency content wherein the parameter generator is configured to derive spectral envelope parameters for the second parameter set for the second frequency content by an extrapolation from lower to higher frequencies of energy information of a shaped spectral envelope of the first frequency content.

According to another embodiment, a method of generating a wideband signal using a lowband input signal and a first parameter set describing the frequency content above a maximum frequency of the lowband input signal and up to a first frequency, wherein parameters describing a frequency content above the first frequency are not included in the first parameter set, may have the steps of: performing a guided bandwidth extension operation using the lowband input signal and the first parameter set to generate a first frequency content extending up to the first frequency by extracting the first parameter set and the lowband input signal from a bitstream and by performing the guided bandwidth extension using patching of the lowband input signal and the first parameter set comprising shaping using the first parameter set to obtain a first shaped signal, wherein the patching of the lowband input signal generates the first frequency content; and performing a blind bandwidth extension operation using the first frequency content and a second parameter set to generate a second frequency content extending up to a second frequency being higher than the first frequency by using a patching of the first shaped signal and using the second parameter set, wherein the patching of the first shaped signal generates the second frequency content, wherein the performing a blind bandwidth extension operation comprises generating the second parameter set from the first frequency content by deriving spectral envelope parameters for the second parameter set for the second frequency content by an extrapolation from lower to higher frequencies of energy information of a shaped spectral envelope of the first frequency content.

Another embodiment may have a computer program comprising a program code for performing, when running on a computer, the inventive method.

The present invention is based on the finding that for improving the audio quality and/or decreasing the bitrate, a guided bandwidth extension operation is combined with a blind bandwidth extension operation. A blind bandwidth extension operation is a bandwidth extension operation, for which no parameters have been transmitted. Stated differently, a blind bandwidth extension operation will result in spectral components of a signal which belong to frequencies above a maximum frequency, for which bandwidth extension parameters have been transmitted in the bitstream.

A processor for performing a guided bandwidth extension operation using the lowband input signal and a transmitted parameter set to generate a first frequency content extending up to the first frequency is additionally adapted for performing a blind bandwidth extension operation using the lowband signal or the first frequency content and a second parameter set to generate a second frequency content extending up to a second frequency being higher than the first frequency. The second parameter is not transmitted from a bandwidth extension encoder, but is generated by a parameter generator for generating the second parameter set from the first parameter set or from the first frequency content alone on the bandwidth extension decoder side. Stated differently, the blind bandwidth extension operation may operate similarly to the guided bandwidth extension operation. The difference, however, is that any parametric data which is used by the bandwidth extension operation is generated on an encoder-side and is transmitted from the encoder to the decoder. For a blind bandwidth extension operation, however, no parameters are generated on the encoder side and are not transmitted from the encoder to the decoder, but are solely and only produced on the decoder-side using the information available on the decoder, but without using any information on the corresponding frequency content of the original signal. Information on the original audio signal corresponding to the frequency components generated by the blind bandwidth extension operation are not at all available at the decoder, since neither the lowband signal nor the transmitted parametric data for the first frequency content include any information on the second frequency content. This information is generated on the decoder-side alone without using any transmitted parametric data, i.e., a "blind" way.

It is an advantage of the present invention that the present invention further improves the perceptual quality of bandwidth extended signals by combining a guided bandwidth extension (gBWE) with a blind bandwidth extension (bBWE). The present invention relies on exploiting the correlation of a high frequency content and a very high frequency content, where the high frequency content corresponds to the frequency bandwidth covered by the transmitted parametric data used in the above referenced contemporary bandwidth extension schemes.

The subject of the present invention is to further improve the perceptual quality of BWE signals by combining guided BWE (gBWE) with a blind BWE (bBWE). This is achieved by exploiting the correlation of high and very high frequency content.

Contemporary bandwidth extension schemes, like spectral band replication (SBR) or harmonic bandwidth extension (HBE) firstly carry out a patching operation in order to generate HF content. This patching can be any kind of non linear processing such as clipping, taking absolute values or phase vocoders; it can also incorporate single sideband modulation, or interpolation. The generated patches are then adapted to the original HF content with the help of additional parameters.

Aside from gBWE, there are bBWE methods that simply aim at extending bandwidth of audio signals. This can be done by inserting HF noise, clipping, etc. but without any side information.

The application of state-of-the-art BWE methods produces band limited signals and does not fully exploit redundancy within HF content of signals. Therefore, the maximal possible bandwidth is not achieved. A hard low-pass filtered signal can additionally perceived as tonal with the pitch of the cutoff frequency of the low pass filter, in particular, if the signal is noise-like. Additionally, such a low pass filter can produce temporal distortions.

These disadvantages are addressed by the present invention in that the blind bandwidth extension operation is applied to the very high frequency content, i.e. the second frequency content extending to the second frequency which is higher than the first frequency. In order to nevertheless keep the transmission rate low, no parametric data is transmitted from an encoder to a decoder for this second frequency content and is therefore not received by the apparatus for generating a wideband signal.

The proposed concept, therefore, avoids a tonality due a steep filter slope at a cutoff frequency of a signal. Furthermore, temporal distortions are reduced due to these filter characteristics. Additionally, the present invention results in a widening of the perceived bandwidth of the signal without additional or only small side information. It can be applied as a post processor on top of any underlying bandwidth extension method.

The inventive concept is, therefore, suitable for all audio applications that use a parameter driven bandwidth extension scheme or is also useable for any audio or speech coder which is enhanced with a decoder-side bandwidth extension operation for an enhanced audio quality.

BRIEF DESCRIPTION OF THE DRAWINGS

Embodiments of the present invention will be detailed subsequently referring to the appended drawings, in which.

DETAILED DESCRIPTION OF THE INVENTION

Figure 2A:
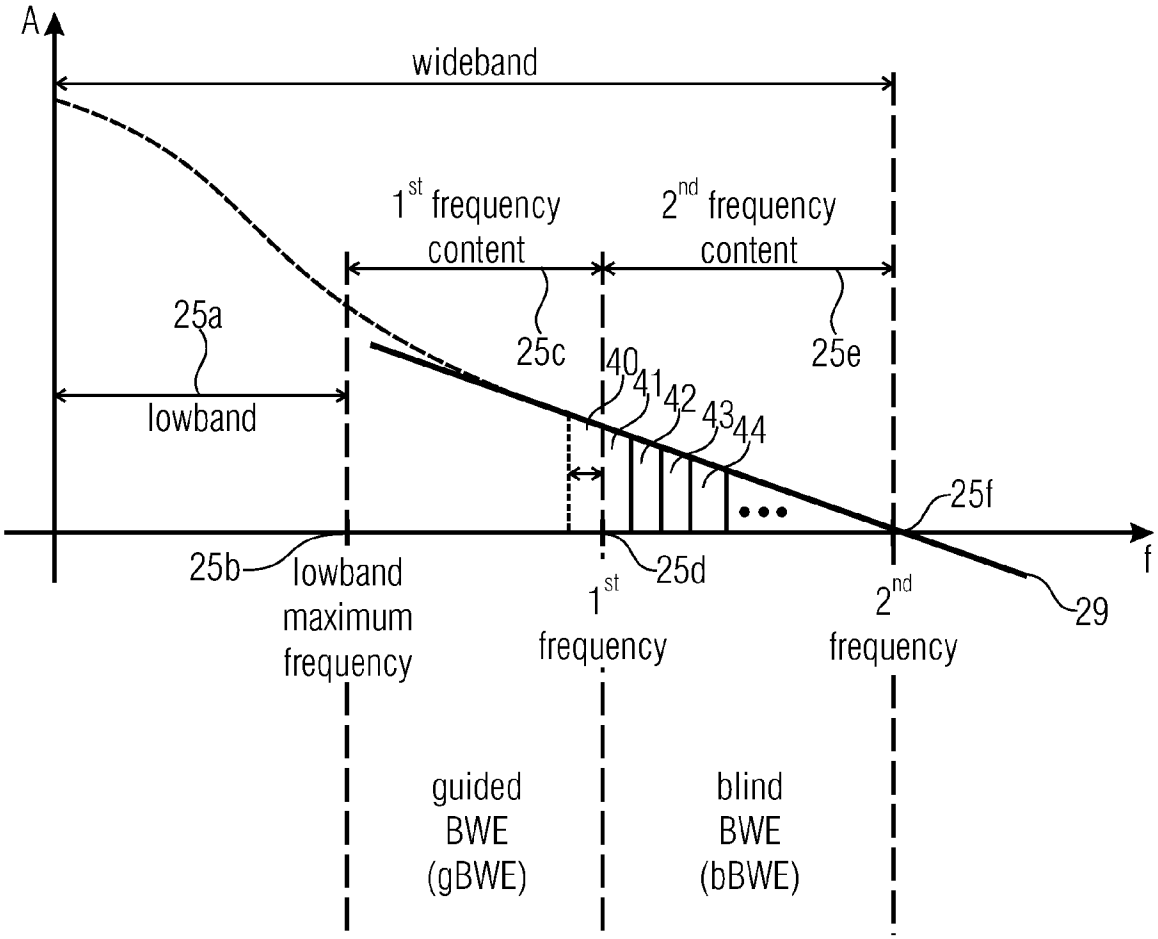
FIG. 2*a* illustrates a diagram of the frequency content of a wideband signal generated from a lowband signal using a guided bandwidth extension for generating the first frequency content and a blind bandwidth extension operation for generating a second frequency content.
Figure 2B:
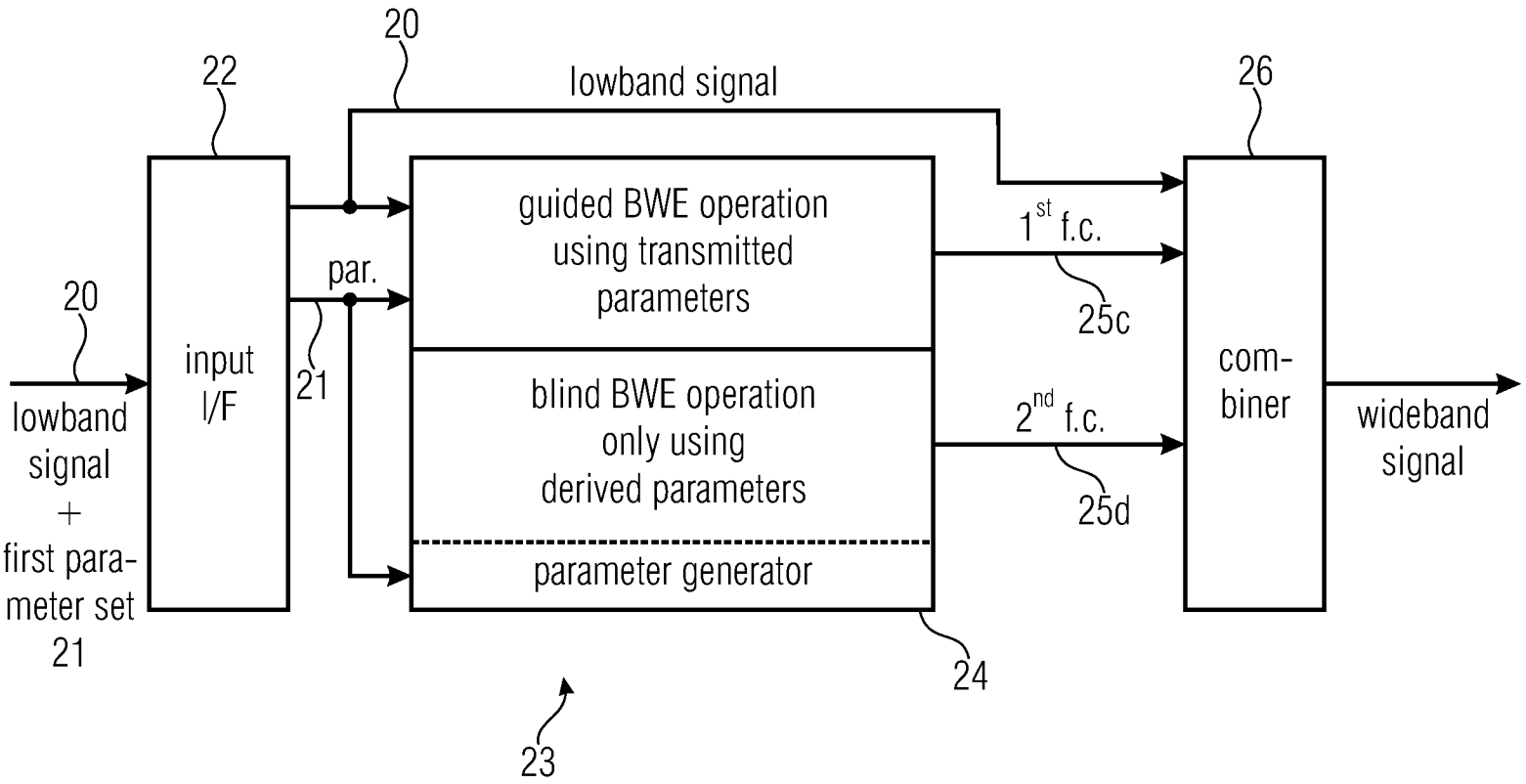
FIG. 2*b* illustrates an embodiment of the apparatus for generating a wideband signal.

FIG. 2*b* illustrates an apparatus for generating a wideband signal using a lowband input signal 20 and a first parameter set 21. The first parameter set describes a frequency content above a maximum frequency of the lowband input signal and up to a first frequency. Parameters describing a frequency content above the first frequency are not included in the first parameter set 21. This data is input into an input interface 22, which separates the lowband signal 20 from the parametric data 21. This data is forwarded to a processor 23 for performing a guided bandwidth extension operation (BWE) using the lowband input signal 20 and the first parameter set 21 to generate a first frequency content extending up to the first frequency. Additionally, the processor 23 is configured for performing a blind bandwidth extension operation using the lowband input signal or the first frequency content and/or a second parameter set to generate a second frequency content extending up to a second frequency being higher than the first frequency. The processor comprises, in order to generate the second parameter set, a parameter generator 24 for generating the second parameter set from the first parameter set 21 or from the first frequency content alone. When the second parameter set is generated from the first frequency content alone, then the first parameter set 21 is not introduced into the parameter generator. However, when the parameter generator 24 uses the first parametric data 21 in order to generate the second parameter set, then the situation is as illustrated in FIG. 2*b*, i.e. that the input interface 22 has a connection to the parameter generator 24.

FIG. 2*a* illustrates a frequency chart in order to illustrate the frequency situation. The lowband input signal has only a lowband bandwidth 25*a*. The lowband bandwidth 25*a* extends from a minimum frequency such as e.g. 20 Hz or so until a lowband maximum frequency 25*b*, which can, for example, be 4 kHz. The first frequency content 25*c* covered by the transmitted parametric data and generated by the guided bandwidth extension concept extends up to a first frequency 25*d*. The first frequency 25*d* may, for example, be at 12 kHz. The second frequency content 25*e* extends up to a second frequency 25*f*, and for the second frequency content 25*e* extending between the first frequency 25*d* and the second frequency 25*f*, no parametric data has been transmitted or generated on an encoder-side. Exemplarily, the second frequency 25*f* may, for example, be 16 kHz.

As illustrated in FIG. 2*a*, the guided bandwidth extension operation is performed for generating the first frequency content and the blind bandwidth operation is performed for generating the second frequency content which is higher in frequency than the first frequency content. The first and the second frequency contents may be non-overlapping The first frequency content 25*c* and the second frequency content 25*d* are transmitted together with the lowband input signal 20 to a combiner 26 in FIG. 2*b*, which generates a wideband signal. Depending on the application, the combiner can be a synthesis filterbank or can be a time domain combiner. The specific implementation of the combiner 26 depends on the implementation of the processor 23, i.e. whether the lowband signal, the first frequency content and the second frequency content are available as time domain signals having corresponding frequency contents, available as subband signals or transformed signals, i.e. signals available in a frequency representation.

Figure 1A:
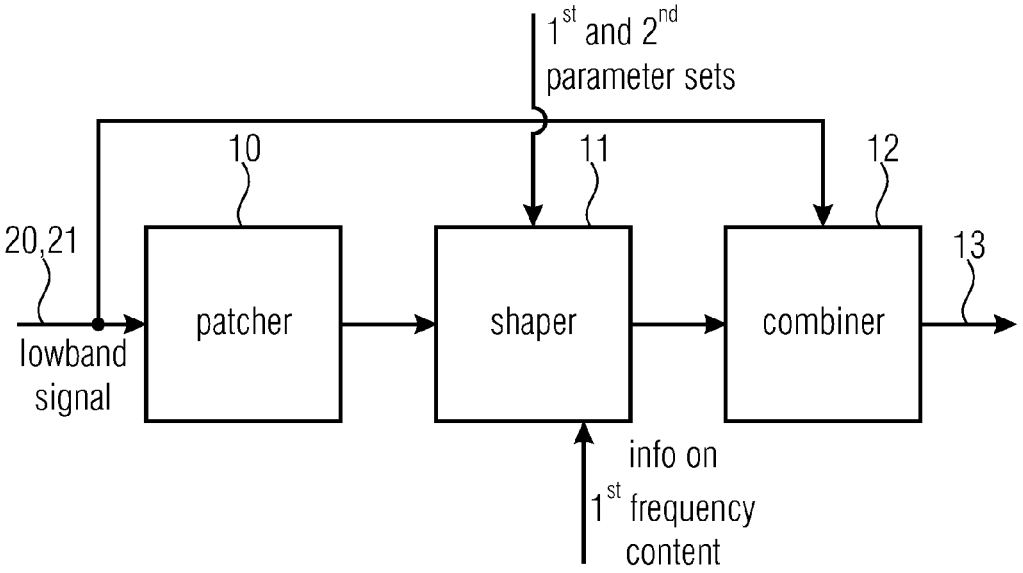
FIGS. 1*a* to 1*c* illustrate different applications of guided and blind bandwidth extension concepts.

FIG. 1*a* illustrates a first implementation for implementing the processor 23 applying the guided bandwidth extension operation and the blind bandwidth extension operation. The lowband signal 21 is input into a patcher 10 in order to generate a patched signal at the output of the patcher 10. The patching operation basically uses a low frequency portion and generates a signal in a higher frequency portion. Patching operations comprise, for a guided bandwidth extension, the patching of adjacent subbands in a source range in a filterbank to adjacent subbands in a target range of the filterbank, harmonically patching subbands in the source range to the target range, clipping, taking absolute values or using a phase vocoder, a single sideband modulation or an interpolation. Patching operations for the blind bandwidth extension comprise inserting noise in the second frequency content or clipping a signal comprising the first frequency content or the lowband to generate higher spectral components.

The patched signal is input into a shaper 11 and at the output of the shaper 11 a shaped, patched signal is obtained. Then, in a combiner 12 the lowband signal 21 and the shaped, patched signal output by the shaper 11 are combined in order to obtain the wideband signal 13 at the output of the combiner.

Figure 1B:
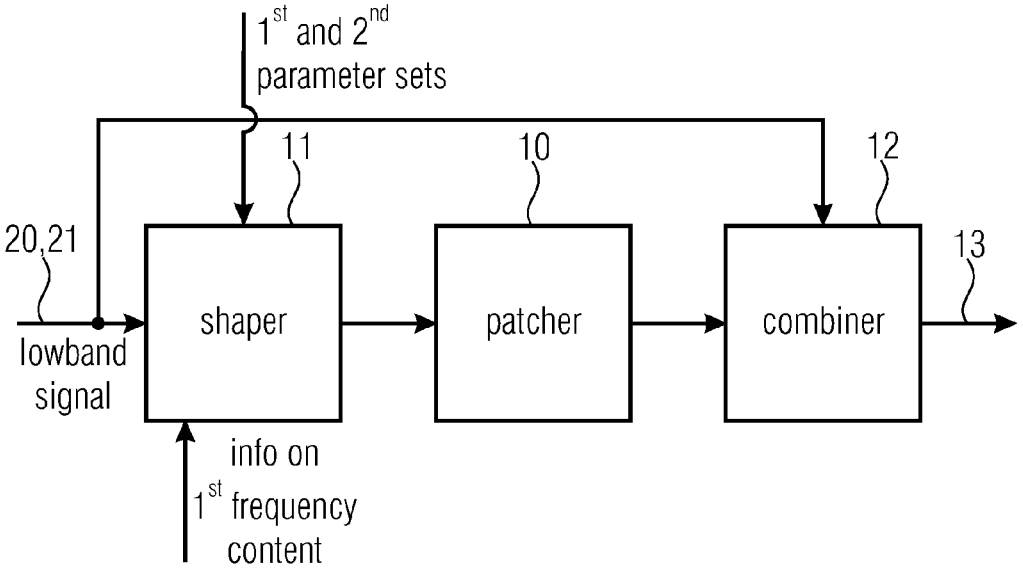

FIG. 1*b* illustrates a different implementation, where the order of the patcher 10 and the shaper 11 are reversed. The shaper 11 is configured for shaping the lowband signal 21 using the first parameter set for the guided bandwidth extension processing and the second parameter set and/or information on the first frequency content in order to generate a shaped lowband signal. This shaped lowband signal at the output of shaper 11 has the same frequency content as the original lowband signal, but is now patched by a patcher 10 to the high frequency range comprising the first frequency content 25*a* and the second frequency content 25*e* as illustrated in FIG. 2*a*. Then, the patched signal at the output of the patcher, which is already shaped due to the fact that the shaping was performed before patching, is combined with the lowband signal 21 in the combiner 12.

Therefore, the difference between FIG. 1*b* and FIG. 1*a* is that the order between the shaper 11 and the patcher 10 is reversed.

In an alternative implementation, the patcher is directly applied to the lowband signal as in FIG. 1*a*. However, the lowband signal 21 and the patched but not yet shaped signal are then combined in order to obtain a combined signal at the output of block 12. This combined signal already has the frequency content 25*a*, 25*c*, 25*e* of FIG. 2*a*, but the first frequency content 25*c* and the second frequency content 25*e* are not yet shaped. This shaping of the high frequency content of the combined signal is then performed by the shaper 11 connected subsequent to the combiner 12.

Figure 1C:
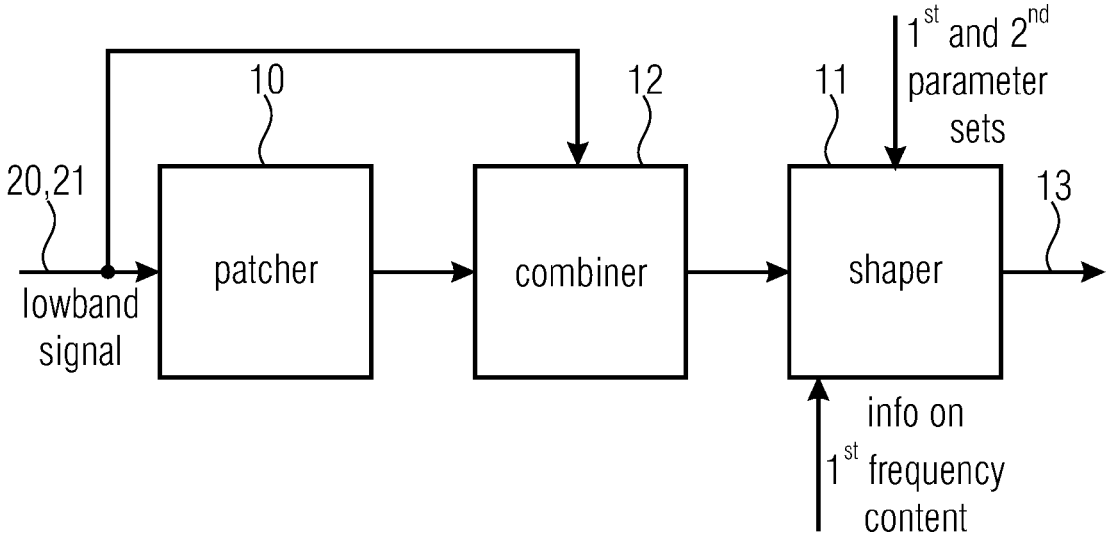

In all implementations of the shaper in FIGS. 1*a*, 1*b* and 1*c*, the shaper uses the first set of parameters for performing the guided bandwidth extension and the second set of parameters for performing the blind bandwidth extension, where the second set of parameters is derived from the first set of parameters and/or the first frequency content by the parameter generator 24 illustrated in FIG. 2*b*, but not illustrated in FIG. 1*a*, 1*b* or 1*c*.

Figure 3:
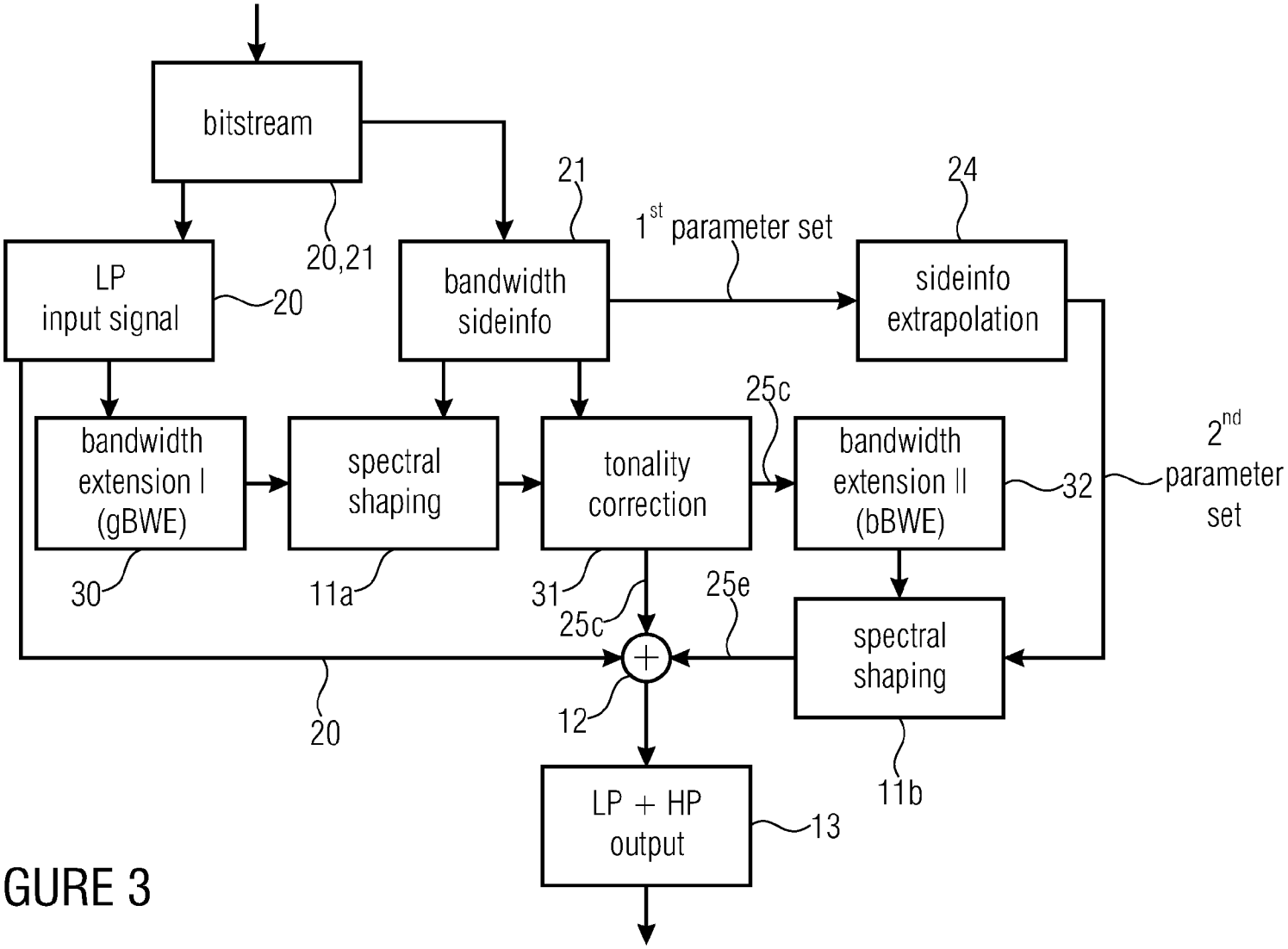
FIG. 3 illustrates a further embodiment of an apparatus or method for generating a wideband signal.

FIG. 3 illustrates a further embodiment of the present invention. The bitstream 20 is received from an encoder not shown in FIG. 3. The bitstream is separated into the lowband or low pass (LP) input signal 20 and the first parameter set 21 illustrated at "bandwidth side information" (sideinfo) in FIG. 3. The low pass input signal 20 is forwarded to a bandwidth extension I block 30 for performing the patching illustrated by the patcher in FIG. 1*a*, 1*b* or 1*c*. Then, the patched signal generated by the bandwidth extension block 30 for implementing the guided bandwidth extension operation is forwarded to a spectral shaper 11*a* for performing the spectral shaping using the bandwidth side information 21 included in the bitstream. The output of the spectral shaping block 11*a* is then forwarded to a tonality correction block 21 in order to obtain the output signal of the guided bandwidth extension. This output signal covering the first frequency content 25*c* is forwarded to a combiner 12 on the one hand and to the blind bandwidth extension II block 32. The bandwidth extension II block 32 performs a patching using the first frequency content 25*c* in this embodiment, although the bandwidth extension II block 32 could also use the lowband signal. However, due to the better correlation between the first frequency content and the second frequency content, it is advantageous to use the first frequency content 25*c* for performing the blind bandwidth extension in block 32. Then, spectral shaping is performed in block 11*b* with the second frequency content 25*e*, where the information for performing this spectral shaping is forwarded by the parameter generator or sideinfo extrapolation block 24, which calculates the second parameter set from the first parameter set. Then, the spectrally shaped second frequency content 25*e* is combined with the first frequency content 25*c* and the lowband signal 20 in the combiner 12 in order to obtain the wideband signal 13.

In embodiments of the present invention, a blind bandwidth extension operation is applied on top of the guided bandwidth extension operation. In FIG. 3 this is illustrated by using the transmitted first parameter set in blocks 11*a* and 31, and by using the second parameter set not transmitted from the encoder to the decoder by block 11*b*. The output of the guided bandwidth extension operation is used for further extending the bandwidth of the signal without any additional side information as illustrated by forwarding the first frequency content 25*c* to block 32 in FIG. 3. As tonality and spectral shape are already adapted to the signal and one can assume that the high frequency content does not change significantly for very high frequencies, the processed extended signal obtained at block 31 is patched in order to further extend it. It is advantageous to use the upper frequency content, i.e., the first frequency content, for the blind bandwidth extension part, but arbitrary parts of the spectrum could also be used.

For the blind bandwidth extension, the side information that was used for the guided bandwidth extension can be extrapolated as illustrated by the parameter generator or sideinfo extrapolation block 24. The spectral shaping of the blind bandwidth extension part, i.e. the application of energy or power parameters per band of the blind bandwidth extension part, corresponds to the spectral shaping in block 11*b*. To this end, the energy parameters, i.e., parameters being a measure depending on the energy in a frequency band, for the frequency bands of the second frequency content 25*e* have to be calculated. This can be done by defining the regression line for a logarithm of the energy of the highest 1 to 4 kHz of the guided bandwidth extension signal. This regression line is illustrated at 29 in FIG. 2*a*. It is advantageous that the derivative of this extrapolated line is smaller than one.

An alternative implementation can be that the energy of the highest band of the first frequency content illustrated at 14 in FIG. 2*a* is measured and then the energies for the next bands 41, 42, 43 and 44 of the second frequency content 25*e* are reduced by an arbitrary amount such as 1.5 or 3 dB.

Hence, the second parameter set comprises, as a minimum, the energy values for the bands 41 to 44 of the second frequency content. These energy values can be calculated using the energy values included in the first parameter set, but can, as illustrated in the context of FIG. 2*a*, also be calculated without the first parameter set. Therefore, the parameter generator 24 only optionally receives the first parameter set and receives the first frequency content in order to either determine the regression line or in order to determine the energy of the highest band 40 of the first frequency content. When, however, the energy values for the bands 41 to 44 are calculated from the first parameter set alone, then the first frequency content is not necessitated for calculating the second parameter set. In other embodiments the energy values for the second frequency content can also be calculated using a combination of the first frequency content and the energy values included in the first parameter set.

Additional parameters such as noise floor and inverse filtering can either be extrapolated or neglected for the blind bandwidth extension. If they are not taken into account in the blind bandwidth extension, the parameters used for guided bandwidth extension, i.e. the transmitted parameters 21, are also applied to control the spectral part processed by the blind bandwidth extension (BWE II) illustrated at 32 in FIG. 3. Alternatively, any other shaping operation different from spectral shaping using the energy parameters can be omitted.

Figure 4:
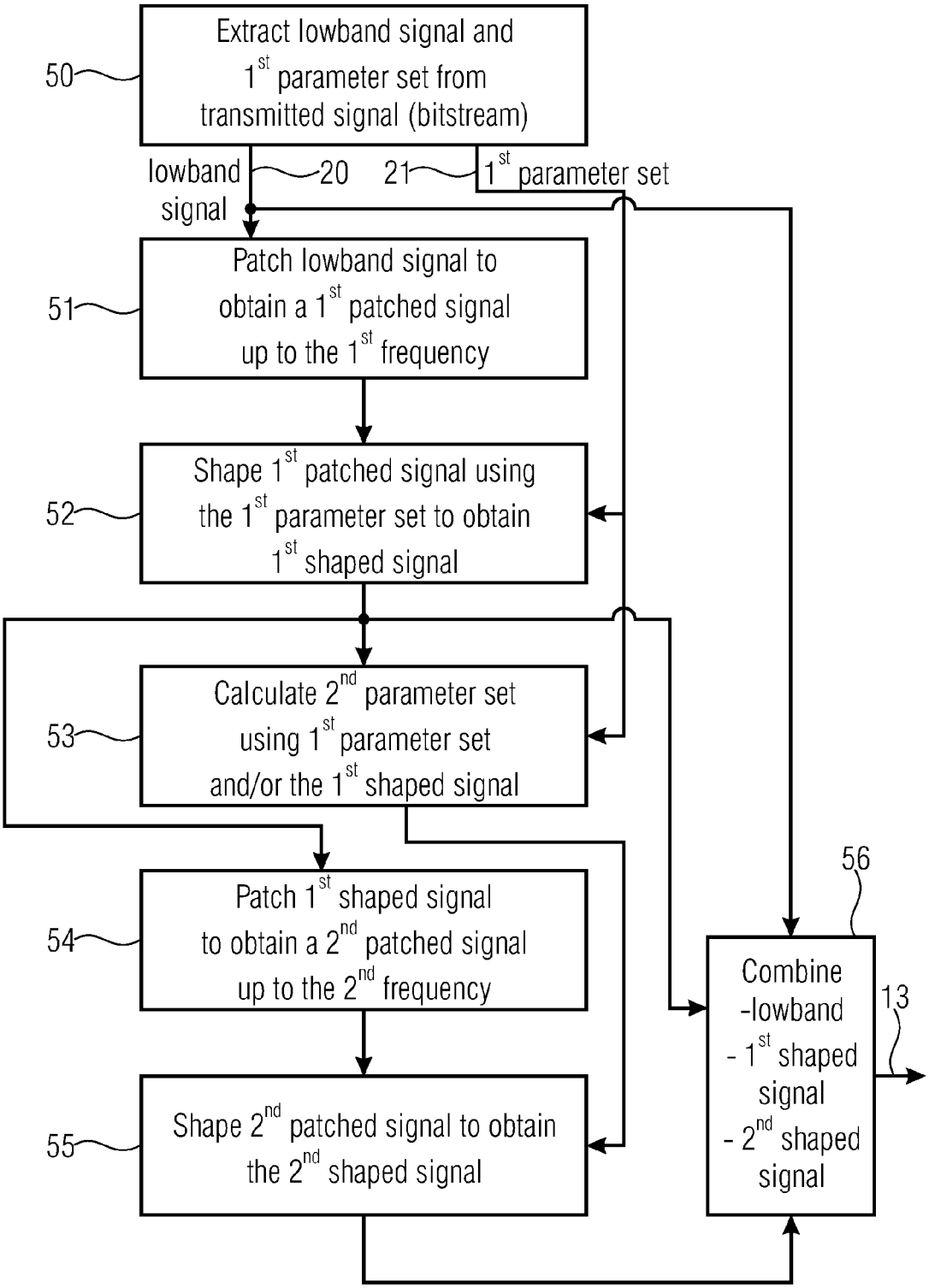
FIG. 4 illustrates a flowchart for implementing an embodiment of the inventive concept.

FIG. 4 illustrates an implementation of the inventive concept in the form of a flow chart. In step 50, which is implemented by the input interface 22 of FIG. 2*b*, the lowband signal and the first parameter set are extracted from the transmitted signal (bitstream). The lowband signal 20 is then used in step 51 for patching the lowband signal to obtain a first patched signal which has a bandwidth extending up to the first frequency. Then, in step 52 the first patched signal generated by step 51 is shaped using the first parameter set to obtain the first shaped signal corresponding to the signal output by the tonality correction block 31 illustrated at 25*c* in FIG. 3. Step 53 illustrates the calculation of the second parameter set using the first parameter set and/or the first shaped signal. Step 54 illustrates a patching of the first shaped signal to obtain a second patched signal which extends up to the second frequency 25*f* illustrated in FIG. 2*a*. As illustrated in step 55, the second patch signal is then shaped to obtain the second shaped signal and, in a further step 56, the lowband, the first shaped signal and the second shaped signal are combined to finally obtain the wideband signal 13.

As discussed earlier, the second parameter set can be derived from the first parameter set and/or the first frequency content in different manners, where for some implementations only the first frequency content is used and the first parameter set is not used, where for other applications only the first parameter set is used and the first frequency content is not used, and where for further implementations a combination of the first parameter set and the first frequency content is used. Furthermore, it is to be noted that for parameters other than the envelope adjustment energy parameters, those parameters cannot be used at all in the blind bandwidth extension operation or can be extrapolated from the first parameter set where a very straightforward way of extrapolating is using the same parameters in the second frequency content 25*e* which have been generated by the encoder for the first frequency content 25*c*. When, for example, it is considered that the first frequency content consists of twenty bands, and when the second frequency content consists of thirty bands, then the parameters for the first twenty bands of the second frequency content would be identical to the parameters for the first twenty bands of the first frequency content, and the remaining ten parameters for the last ten frequency bands of the second frequency content would be derived by extrapolation, or a tonality correction would not be applied in these last ten frequency bands at all.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

The inventive transmitted signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a non-transitory data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are performed by any hardware apparatus.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. Apparatus for generating a wideband audio signal using a lowband audio input signal and a first parameter set describing the frequency content above a maximum frequency of the lowband audio input signal and up to a first frequency being higher than the maximum frequency of the lowband audio input signal, wherein parameters describing a frequency content above the first frequency are not comprised in the first parameter set, comprising:

a processor that performs a guided bandwidth extension operation using the lowband audio input signal and the first parameter set and generates a first frequency content comprising frequencies being higher than the maximum frequency of the lowband audio input signal and extending up to the first frequency, and that performs a blind bandwidth extension operation using the first frequency content comprising the frequencies being higher than the maximum frequency of the lowband audio input signal and extending up to the first frequency and a second parameter set different from the first parameter set and generates a second frequency content comprising frequencies extending up to a second frequency being higher than the first frequency, wherein the processor, in performing of the guided bandwidth extension operation extracts the first parameter set and the lowband audio input signal from a bitstream;

performs the guided bandwidth extension operation using a patching of the lowband audio input signal and using the first parameter set, the performing of the guided bandwidth extension operation comprising shaping a signal, based on the lowband audio input signal, to be shaped using the first parameter set to acquire a first shaped signal, wherein the guided bandwidth extension operation generates a first bandwidth extended audio signal comprising the first frequency content, the first bandwidth extended audio signal having a shaped spectral envelope, the first frequency content comprising the frequencies being higher than the maximum frequency of the lowband audio input signal and extending up to the first frequency;

wherein the processor comprises a parameter generator that generates the second parameter set from the first frequency content comprising the frequencies being higher than the maximum frequency of the lowband audio input signal and extending up to the first frequency, wherein the parameter generator performs an extrapolation of energy information of the shaped spectral envelope of the first bandwidth extended audio signal having the first frequency content comprising the frequencies being higher than the maximum frequency of the lowband audio input signal and extending up to the first frequency, to obtain extrapolated energy information for the second frequency content comprising frequencies extending up to the second frequency being higher than the first frequency, and derives, from a result of the extrapolation, spectral envelope parameters for the second parameter set for the second frequency content comprising the frequencies extending up to the second frequency being higher than the first frequency, wherein the processor, in performing the blind bandwidth extension operation, uses a patching of the first bandwidth extended audio signal having the shaped spectral envelope and uses the spectral envelope parameters of the second parameter set, wherein the patching of the first bandwidth extended audio signal generates a second bandwidth extended audio signal having the second frequency content having a spectral envelope defined by the spectral envelope parameters of the second parameter set, wherein the processor comprises a combiner that combines the first bandwidth extended audio signal and the second bandwidth extended audio signal, and the lowband audio signal to obtain and output the wideband audio signal, and wherein at least one of the processor and the parameter generator comprises a hardware implementation.

2. Apparatus in accordance with claim 1, wherein the processor comprises:

a patcher for generating a patched signal comprising the first frequency content extending up to the first frequency, the patched signal comprising the second frequency content extending up to the second frequency;

a shaper for shaping the lowband audio input signal before generating the patched signal, for shaping the patched signal or for shaping a combination signal using a shaping operation; and a combiner for combing the lowband audio input signal and the patched signal before or subsequent to the shaping operation to obtain the combination signal, wherein the combination signal is the wideband audio signal or wherein the wideband audio signal is derived from the combination signal by the shaping operation, wherein the shaper is configured to perform the shaping operation so that the first frequency content of the wideband audio signal is shaped using the first parameter set and that the second frequency content of the wideband audio signal is influenced by the first frequency content and by the second parameter set derived from the first parameter set by the parameter generator.

3. Apparatus in accordance with claim 1, wherein the parameter generator is configured to perform the extrapolation by decreasing an energy of a band of the second frequency content with respect to an energy in a lower frequency adjacent band by a predetermined value, wherein an energy in a highest frequency band of the first frequency content is used as a starting value.

4. Apparatus in accordance with claim 1, wherein the parameter generator is configured to perform the extrapolation by calculating a regression line using a predetermined portion of the first frequency content and by extrapolating the regression line in frequency into the second frequency content to obtain energy values for frequency bands in the second frequency content.

5. Apparatus in accordance with claim 4, wherein the parameter generator is configured to perform the extrapolation by calculating a regression line in such a way that a derivative of the regression line is smaller than one.

6. Apparatus in accordance with claim 1, in which the first parameter set comprising a sequence of parameters of a parameter kind, the sequence being defined over a frequency in the first frequency content, and wherein the parameter generator is configured to extrapolate the sequence into the second frequency content to derive a sequence of parameters of the same kind for the second parameter set.

7. Apparatus in accordance with claim 6, in which the first parameter set comprises, as further parameter kinds, one or more members of the group comprising noise parameters, tonality parameters or missing harmonics parameters.

8. Apparatus in accordance with claim 1, in which the processor is configured to use the noise parameters and tonality parameters in the first parameter set for the guided bandwidth extension operation and to not use tonality parameters or noise parameters in the blind bandwidth extension operation, wherein the blind bandwidth extension operation is based on a patching of a result of the guided bandwidth extension operation.

9. Apparatus in accordance with claim 1, in which the lowband audio input signal is encoded, wherein the apparatus further comprises a decoder for decoding the encoded lowband audio input signal.

10. Apparatus in accordance with claim 1, in which the processor is configured to use, as a patching method for the guided bandwidth extension operation, the patching of adjacent subbands in a source range in a filterbank to adjacent subbands in a target range of the filterbank, harmonically patching subbands in the source range to the target range, clipping, taking absolute values or using a phase vocoder, a single sideband modulation or an interpolation.

11. Apparatus in accordance with claim 1, wherein the processor is configured to use, as a patching method for the blind bandwidth extension operation, inserting high frequency noise or clipping.

12. Method of generating a wideband audio signal using a lowband audio input signal and a first parameter set describing the frequency content above a maximum frequency of the lowband audio input signal and up to a first frequency being higher than the maximum frequency of the lowband audio input signal, wherein parameters describing a frequency content above the first frequency are not comprised in the first parameter set, comprising:

performing, by a processor, a guided bandwidth extension operation using the lowband audio input signal and the first parameter set and generating a first frequency content comprising frequencies being higher than the maximum frequency of the lowband audio input signal and extending up to the first frequency, the performing of the guided bandwidth extension operation comprising:

extracting the first parameter set and the lowband audio input signal from a bitstream;

patching of the lowband audio input signal and using the first parameter set, the performing of the guided bandwidth extension operation comprising shaping a signal, based on the lowband audio input signal, to be shaped using the first parameter set to acquire a first shaped signal, wherein the guided bandwidth extension operation generates a first bandwidth extended audio signal comprising the first frequency content, the first bandwidth extended audio signal having a shaped spectral envelope, the first frequency content comprising the frequencies being higher than the maximum frequency of the lowband audio input signal and extending up to the first frequency, and performing, by the processor, a blind bandwidth extension operation using the first frequency content comprising the frequencies being higher than the maximum frequency of the lowband audio input signal and extending up to the first frequency and a second parameter set different from the first parameter set and generating a second frequency content comprising frequencies extending up to a second frequency being higher than the first frequency wherein the performing the blind bandwidth extension operation comprises generating, by a parameter generator, the second parameter set from the first frequency content comprising the frequencies being higher than the maximum frequency of the lowband audio input signal and extending up to the first frequency wherein the generating, by the parameter generator, comprises:

performing an extrapolation of energy information of the shaped spectral envelope of the first bandwidth extended audio signal having the first frequency content comprising the frequencies being higher than the maximum frequency of the lowband audio input signal and extending up to the first frequency to obtain extrapolated energy information for the second frequency content comprising frequencies extending up to the second frequency being higher than the first frequency, and deriving, from a result of the extrapolation, spectral envelope parameters for the second parameter set for the second frequency content comprising the frequencies extending up to the second frequency being higher than the first frequency, wherein the performing the blind bandwidth extension operation further comprises:

patching of the first bandwidth extended audio signal having the shaped spectral envelope and using the spectral envelope parameters of the second parameter set, wherein the patching of the first bandwidth extended audio signal generates a second bandwidth extended audio signal having the second frequency content having a spectral envelope defined by the spectral envelope parameters of the second parameter set, wherein the processor comprises a combiner that combines the first bandwidth extended audio signal and the second bandwidth extended audio signal, and the lowband audio signal to obtain and output the wideband audio signal, wherein at least one of the processor and the parameter generator comprises a hardware implementation.

13. Non-transitory storage medium having stored thereon a computer program comprising a program code for performing, when running on a computer, the method of generating a wideband audio signal using a lowband audio input signal and a first parameter set describing the frequency content above a maximum frequency of the lowband audio input signal and up to a first frequency being higher than the maximum frequency of the lowband audio input signal, wherein parameters describing a frequency content above the first frequency are not comprised in the first parameter set, the method comprising:

performing a guided bandwidth extension operation using the lowband audio input signal and the first parameter set and generating a first frequency content comprising frequencies being higher than the maximum frequency of the lowband audio input signal and extending up to the first frequency, the performing of the guided bandwidth extension operation comprising:

extracting the first parameter set and the lowband audio input signal from a bitstream;

patching of the lowband audio input signal and using the first parameter set, the performing of the guided bandwidth extension operation comprising shaping a signal to be shaped using the first parameter set to acquire a first shaped signal, based on the lowband audio input signal, wherein the guided bandwidth extension operation generates a first bandwidth extended audio signal comprising the first frequency content, the first bandwidth extended audio signal having a shaped spectral envelope, the first frequency content comprising the frequencies being higher than the maximum frequency of the lowband audio input signal and extending up to the first frequency, and performing a blind bandwidth extension operation using the first frequency content comprising the frequencies being higher than the maximum frequency of the lowband audio input signal and extending up to the first frequency and a second parameter set different from the first parameter set and generating a second frequency content comprising frequencies extending up to a second frequency being higher than the first frequency wherein the performing the blind bandwidth extension operation comprises generating the second parameter set from the first frequency content comprising the frequencies being higher than the maximum frequency of the lowband audio input signal and extending up to the first frequency, wherein the generating comprises:

performing an extrapolation of energy information of the shaped spectral envelope of the first bandwidth extended audio signal having the first frequency content comprising the frequencies being higher than the maximum frequency of the lowband audio input signal and extending up to the first frequency to obtain extrapolated energy information for the second frequency content comprising frequencies extending up to the second frequency being higher than the first frequency, and deriving, from a result of the extrapolation, spectral envelope parameters for the second parameter set for the second frequency content comprising the frequencies extending up to the second frequency being higher than the first frequency, and patching of the first bandwidth extended audio signal having the shaped spectral envelope and using the spectral envelope parameters of the second parameter set, wherein the patching of the first bandwidth extended audio signal generates a second bandwidth extended audio signal having the second frequency content having a spectral envelope defined by the spectral envelope parameters of the second parameter set, further comprising combining the first bandwidth extended audio signal and the second bandwidth extended audio signal, and the lowband audio signal to obtain and output the wideband audio signal.

* * * * *